United States Patent [19]

Chen et al.

[11] 4,296,058

[45] Oct. 20, 1981

[54] PROCESS FOR ENHANCING THE UNIFORMITY OF DYE UPTAKE OF FALSE TWIST TEXTURIZED POLYETHYLENE TEREPHTHALATE FIBROUS MATERIALS

[75] Inventors: John C. Chen, North Plainfield; Herbert L. Davis, Convent Station, both of N.J.

[73] Assignee: Celanese Corporation, New York, N.Y.

[21] Appl. No.: 953,662

[22] Filed: Oct. 23, 1978

[51] Int. Cl.[3] ..... D01F 1/04

[52] U.S. Cl. ..... 264/78; 57/288; 57/290; 264/103; 264/235; 264/235.6

[58] Field of Search ..... 264/176 F, 235.6, 210 F, 264/78, 235, 342, 103; 57/290, 288

[56] References Cited

U.S. PATENT DOCUMENTS

| | | | |
|---|---|---|---|
| 3,634,580 | 1/1972 | Watase et al. | 264/235 |
| 3,797,221 | 3/1974 | Ikeda et al. | 57/288 |
| 3,927,167 | 12/1975 | Reese | 264/235.6 |
| 3,936,999 | 2/1976 | Ikeda et al. | 57/288 |
| 3,946,100 | 3/1976 | Davis et al. | 264/234 |
| 3,977,175 | 8/1976 | Yoshikawa et al. | 264/210 F |
| 3,998,042 | 12/1976 | Reese | 264/235.6 |
| 4,003,974 | 1/1977 | Chantry et al. | 264/342 RE |
| 4,070,432 | 1/1978 | Tamaddon | 264/342 RE |
| 4,145,870 | 3/1979 | Klee et al. | 57/247 |
| 4,164,838 | 8/1979 | Bach et al. | 57/247 |

FOREIGN PATENT DOCUMENTS

| | | | |
|---|---|---|---|
| 45-1932 | 1/1970 | Japan | 264/210 F |
| 49-22856 | 6/1974 | Japan . | |
| 51-82020 | 7/1976 | Japan | 264/210 F |
| 51-99112 | 9/1976 | Japan | 264/210 F |

*Primary Examiner*—Jay H. Woo
*Attorney, Agent, or Firm*—Thomas J. Morgan

[57] ABSTRACT

The present invention provides an improvement in a process for providing a dyed, false twist texturized, fibrous material comprising at least 85 mole percent polyethylene terephthalate which is subject to variations in dye uptake induced by the false twist texturizing treatment conducted on said fibrous material prior to or concurrently with a dyeing process by enhancing the uniformity of dye uptake of the fibrous material. The enhancement in the uniformity of dye uptake is achieved by subjecting the fibrous material, which has been previously oriented but prior to false twist texturizing, to an annealing step at a specifically defined temperature for a specifically defined length of time while controlling the length of the fibrous material in a specifically defined manner.

18 Claims, 1 Drawing Figure

FIGURE
EFFECT OF TEMPERATURE VARIATIONS ON DYE UPTAKE
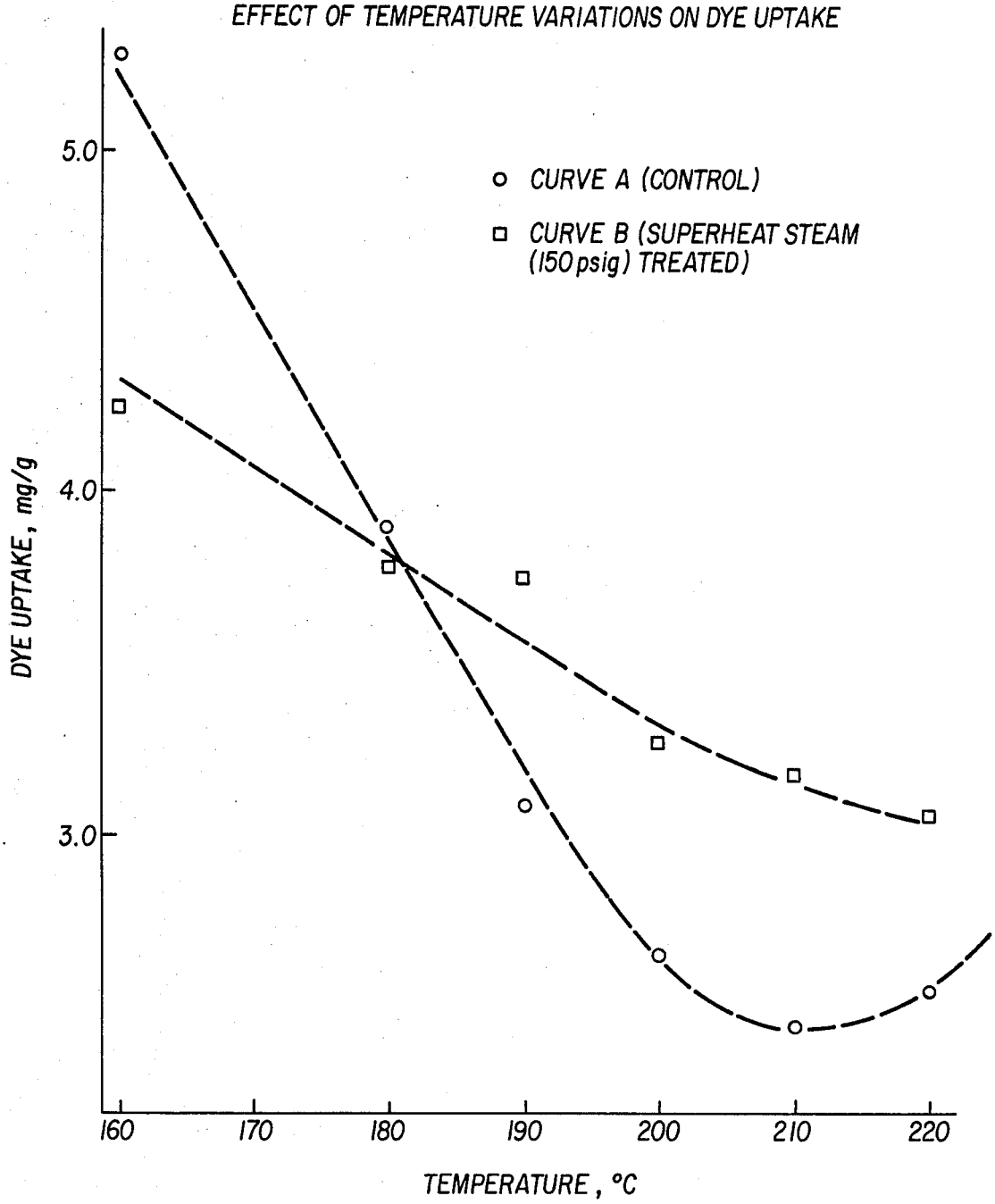

PROCESS FOR ENHANCING THE UNIFORMITY OF DYE UPTAKE OF FALSE TWIST TEXTURIZED POLYETHYLENE TEREPHTHALATE FIBROUS MATERIALS

BACKGROUND OF THE INVENTION

Polyethylene terephthalate filament yarns, as well as other fibrous materials, are sometimes subjected to a series of thermomechanical treatments, such as false twist texturizing, subsequent to spinning and prior to or concurrently with dyeing to obtain a property-balance dictated by the end use of the fibrous material.

It has been an observed characteristic of crystalline fibrous materials such as those prepared from polyethylene terephthalate that dye uptake is a function of fiber structure (e.g., degree of crystallinity and orientation) and slight changes in fiber structure will induce variations in the dye uptake (i.e., the ratio of weight of the dye to the weight of the fabric containing the dye).

It is also a generally observed characteristic of crystalline fibrous materials such as polyethylene terephthalate that false twist texturizing treatments of fibrous materials as described herein will induce changes in the fiber structure.

Furthermore, it is well known that, due to inherent design limitations in the heating equipment employed in such false twist texturizing treatments, it is virtually impossible to subject all of the fibrous material which is essentially incorporated into a final end product to a uniform temperature during any particular treatment. The temperature of any false twist texturizing treatment can therefore be characterized as inherently being a range of temperatures.

Consequently, the inherent variation in temperature to which a fibrous material is subjected during false twist texturizing induces a variation in the structure of the fiber which in turn induces a variation in dye uptake. This variation in dye uptake results in an end product having a non-uniform appearance with respect to dyeshade.

Various methods of improving the dye affinity of fibrous materials are illustrated by U.S. Pat. Nos. 3,527,862; 3,558,761; 3,634,580 and 3,739,056.

Typical heat treatments which have been applied to fibrous materials are illustrated by U.S. Pat. Nos. 3,469,001; 3,471,608; 3,527,862; 3,546,329; 3,562,199; 3,562,382; 3,584,103 and 3,595,952.

A method for improving the uniformity of dye uptake is disclosed in U.S. Pat. No. 3,847,544.

None of the above mentioned patents is directed to improving the uniformity of dye uptake in the manner described hereinafter.

Thus, there has been a continuing search for ways to reduce the sensitivity of fibrous materials, such as polyethylene terephthalate, to variations in dye uptake induced by variations in the temperature to which they are subjected during typical false twisting procedures.

The present invention is a result of this search.

It is therefore an object of the present invention to provide a process for enhancing the uniformity of dye uptake of a previously oriented fibrous material comprising a substantial proportion of polyethylene terephthalate which is subjected to a false twist texturizing treatment prior to or concurrently with dyeing.

These and other objects as well as the scope, nature, and utilization of the claimed invention will be apparent from the following detailed description and appended claims.

SUMMARY OF THE INVENTION

In one aspect of the present invention there is provided an improvement in a process for providing a dyed false twist texturized fibrous material comprising at least 85 mole percent polyethylene terephthalate which is subject to variations in dye uptake induced by a false twist texturizing treatment conducted on said fibrous material prior to or concurrently with a dyeing process, the improvement which comprises enhancing the uniformity of dye uptake of said fibrous material by:

(a) providing a fibrous material comprising at least 85 mole percent polyethylene terephthalate having a birefringence of at least 0.1 prior to said false twist texturizing treatment; and (b) annealing said fibrous material of (a) at a temperature of about 100° to about 170° C. while controlling the length thereof in a manner sufficient to prevent a longitudinal shrinkage greater than about 10% and a longitudinal extension greater than about 5% based on the original length of the fibrous material prior to annealing, for a period of about 0.01 to about 1 second.

In another aspect of the present invention there is provided an improvement in a continuous process for providing a dyed false twist texturized fibrous material comprising at least 85 mole percent polyethylene terephthalate which is subject to variations in dye uptake induced by a false twist texturizing treatment conducted on said fibrous material prior to or concurrently with a dyeing process, the improvement which comprises enhancing the uniformity of dye uptake of said fibrous material by:

(a) passing a continuous length of a fibrous material comprising at least 85 mole percent polyethylene terphthalate having a birefringence of about 0.14 to about 0.21 in the direction of its length through an annealing zone while controlling the length thereof in a manner sufficient to prevent a longitudinal shrinkage greater than about 5% and a longitudinal extension greater than about 5% based on the original length of the fibrous material prior to annealing, for a residence time within said annealing zone of about 0.01 to about 1 second prior to said false twist texturizing treatment; and (b) contacting said fibrous material of (a) as it passes through said annealing zone with superheated steam maintained at a temperature of about 100° to about 170° C.

BRIEF DESCRIPTION OF THE DRAWING

The FIGURE is a graphic representation of a plot of dye uptake in milligrams of dye per gram of polyethylene terephthalate fibrous material versus temperature.

DESCRIPTION OF THE PREFERRED EMBODIMENTS

The uniformity of dye uptake of a previously oriented fibrous material is improved by annealing said fibrous material at a specifically defined temperature for a specifically defined length of time while controlling the length of the fibrous material in a specifically defined manner prior to subjecting the fibrous material to a false twist texturizing treatment.

More specifically, the fibrous material utilized in accordance with the process of the present invention is provided from a polymer comprising at least 85 mole percent, preferably about 90 to 100 mole percent polyethylene terephthalate. Thus, although it is preferred that the fibrous material constitute a homopolyester wherein the acid component is derived from terephthalic acid and the glycol component is derived from ethylene glycol, co-polyesters wherein the glycol component further includes minor amounts of other glycols such as diethylene glycol, trimethylene glycol, tetramethylene glycol, hexamethylene glycol, etc., and the acid component further includes minor amounts of other dicarboxylic acids such as isophthalic acid, hexahydro terephthalic acid, bibenzoic acid, adipic acid, sebacic acid, azelaic acid, etc., may also be employed.

The molecular weight of the polyethylene terephthalate should be such that the polymer can be melt spun. Thus, the inherent viscosity as determined from a 0.1% by solution weight of a solution of the polymer in orthochlorophenol at 25° C., should not be less than about 0.6 deciliters per gram (dl/gm) and can vary from about 0.6 to about 0.95 dl/gm.

The fiber forming polymer (e.g., polyethylene terephthalate) used to prepare the fibrous material is provided in a fibrous configuration by melt spinning the polymer in accordance with any of the accepted melt spinning techniques known in the art.

The "orientation" possessed by the fibrous material before undergoing the controlled anneal treatment of the present invention is characterized in terms of birefringence and is herein defined to be that which is sufficient to impart a birefringence to said fibrous material of at least 0.10, preferably from about 0.14 to about 0.21, and most preferably from about 0.18 to about 0.20.

The birefringence of the fibrous material is determined in accordance with the procedures outlined in U.S. Pat. No. 3,681,188 which is herein incorporated by reference.

Typically, the required degree of orientation may be achieved by any method known to those skilled in the art, depending on the manner in which the fibrous material is prepared.

Thus, for example, in accordance with known procedures of the prior art, filaments may be melt spun under low stress conditions wherein the molten polyester is extruded through the orifices of a spinneret, to form filaments which are initially taken up while exerting a relatively low stress on the same. The as-spun fibers typically possess a very low birefringence, preferably about 0.001 to 0.005.

The as-spun fibers are then commonly subjected to a subsequent hot drawing step which may or may not be carried out in-line to achieve the desired degree of orientation suitable for the purposes of the present invention. Thus, typical drawing temperatures employed in the separate hot drawing step will generally not be below the glass transition temperature of the polymer and commonly may range from about 85° to about 180° C.

The draw ratio generally employed during the separate hot drawing step on a filament having a denier per filament (dpf) of about 5 to about 20 typically can vary from about 3:1 to about 5:1, and preferably from about 4:1 to about 5:1. Such hot drawing of as-spun polyethylene terephthalate filaments is commonly conducted upon contact with an appropriate heating device, heated gaseous atmosphere, or heated liquid medium.

Alternatively the desired orientation may be achieved by melt extruding the polyester in accordance with the procedures of commonly assigned U.S. Pat. No. 3,946,100 which is herein incorporated by reference. The procedures of this patent eliminate the necessity for an additional drawing step to achieve orientation of the type described herein.

Regardless of the method adopted for achieving orientation, it is well within the skill of the art to adjust spinning variables, such as the viscosity of the polymer melt as extruded through the spinneret hole, the viscosity of the filament as it changes from molten to solid state in the thread line, temperature regulation, rate of extrusion and windup speed, under any one set of conditions of polymer type, and geometry of the spinneret, in a manner sufficient to achieve the orientation possessed by the fibrous material of the present invention.

Typically, the fibrous material will possess a denier per filament of about 2 to about 10, preferably from about 3 to about 6, and most preferably from about 4 to about 5 and a tenacity of about 3 to about 6, preferably 3.5 to about 4.5 grams per denier (gpd).

The temperature at which the previously oriented fibrous material is annealed can vary from about 100° to about 170° C., preferably from about 120° to about 160° C., and most preferably from about 145° to about 150° C. When the temperature employed is below about 100° C. the improvement in uniformity of dye uptake, if any, is negligible.

When the annealing temperature exceeds about 170° C. the structure of the polymer will be altered to such an extent that the efficiency of the false twist texturizing procedure will suffer.

The annealing procedure is carried out in an annealing zone, for example, in an oven heated to the appropriate temperature through which a continuous run of the yarn or bundle of filaments is passed. Such heat treatment may be by means of a hot fluid heat transfer medium, such as superheated steam, nitrogen, carbon dioxide, air and the like, and mixtures thereof (e.g., using a jacketed tube or shroud), by infrared rays, by dielectric heating or by direct contact of the running yarn or bundle with a heated metal surface, preferably curved, to make good contact.

The duration of exposure to the annealing temperatures can vary from about 0.01 to about 1.0 second, preferably from about 0.02 to about 0.6 second, and most preferably from about 0.04 to about 0.4 second.

When the previously oriented fibrous material is subjected to the annealing procedures outlined above, it will have a propensity to shrink or collapse in the direction of its length. It has been found that in order to achieve the improvements in dye uniformity, the length of the fibrous material during the annealing procedure must be controlled in a manner sufficient to prevent a longitudinal shrinkage of greater than about 10%, (e.g., 5%) and a longitudinal extension greater than about 5%, based on the original length of the fibrous material prior to annealing. Preferably the length of the fibrous material is controlled during annealing in a manner sufficient to obtain a longitudinal shrinkage of about 5 to about 0% (e.g., 5%) based on the original length of the fibrous material prior to annealing.

The required control of length of the fibrous material exercised during the annealing process necessary to achieve the improvement in dye uniformity may be achieved by any means known to those skilled in the art.

Thus, the previously oriented fibrous material can be conveyed in the direction of its length from a first stress isolation device through an annealing zone where it is annealed in the manner described to a second stress isolation device located at the exit of the annealing zone.

Each stress isolation device may conveniently take the form of a pair of skewed rolls.

Accordingly, the previously oriented fibrous material may be wound several times about the first pair of skewed rolls, passed through the annealing zone and wound several times about the second pair of skewed rolls. This arrangement permits isolation and control of the stress induced by shrinkage between the two pairs of rolls, of the fibrous material as it undergoes the anneal treatment.

Consequently, by manipulating the speed ratio, i.e., the differential ratio of the surface speed of the rollers at the exit of the annealing zone to the surface speed of the rollers at the entrance of the annealing zone, the length of the fibrous material can be controlled in the manner required.

Thus, with a speed ratio of 1.0, the surface speeds of the two sets of rollers are equivalent, and the fibrous material will be maintained at constant length (i.e., 0% shrinkage). When the speed ratio is less than 1.0, the fibrous material will undergo relaxation to some degree depending on how low the speed ratio is set. Conversely, if the speed ratio is greater than 1.0 the fibrous material will be stretched during passage through the annealing zone.

In order to obtain the proper control of shrinkage of the fibrous material during annealing, the speed ratio thereof as it passes through the annealing zone can vary from about 0.9 to about 1.0 (i.e., 10 to 0% shrinkage) preferably from about 0.95 to about 0.98 and most preferably about 0.95.

It is appropriate to mention that the propensity of the fibrous material to shrink is always greater than the degree of relaxation permitted by the speed ratios described. Consequently at these speed ratios, although no direct or active tension is applied to the fibrous material, such materials may be said to be under a passive tension which is exerted by the internal stress of restrained shrinkage of the fibrous material itself.

Speed ratios as high as 1.05 (i.e. 5% extension based on the original length of the fibrous material) may also be employed although they are less preferred.

If the degree of shrinkage of the fibrous material exceeds about 10% the fibrous material would lose some of its orientation and will become progressively more brittle.

If the fibrous material is stretched under tension beyond 5% of its original length, such extension can have the effect of redrawing the fibrous material and thereby enhance the sensitivity thereof to variations in dye uptake induced by false twist texturizing.

Control of the length of the fibrous material may also be exercised by monitoring the tension thereof in any manner known in the art to achieve the required fiber length control. The tension is measured at a point immediately below the exit end of the annealing zone. For instance, the tension may be measured by placing a tensionmeter on the fibrous material as it exits the annealing zone and prior to contact with the second isolation device.

The term "fiber" as used in this specification includes continuous filaments, fibers, yarns made from the latter materials and tows.

Dye uptake, as referred to herein, is the weight of dye in milligrams per gram of fiber containing the dye and is determined by dyeing the fibrous material in an aqueous dye bath having a temperature of about 95° C. for 60 minutes. The dye bath contains 4%, by weight, based on the weight of the fibrous material (owf) of a commercially available disperse dye such as Eastman Blue BGLF, or DuPont Latyl Blue BGLF and optionally a dye carrier. The weight ratio of the bath to fibrous material is 40:1.

The dyed sample fibrous material is then scoured to remove excess dye. The dyed and scoured fibrous material is then dissolved in a suitable solvent, such as trifluroacetic acid, and further diluted with an appropriate solvent, e.g., methylene chloride, methanol and/or mixtures thereof. The amount of dye on the fibrous material is determined by measuring the absorbance of the solution on a spectrophotometer. The dye uptake in terms of milligrams of dye per gram of fibrous material is then easily determined.

As stated above, the purpose of the process described herein is to reduce variation in dye uptake which is induced by subsequent false twist texturizing treatments to which the fibrous material is subjected prior to, or concurrently with, dyeing procedures.

False twist texturizing processes, which are well known in the art, are based on a deliberate manipulation of the fiber structure through controlled application of tension, deformation, heat and/or moisture for predetermined times. All stages of false twist texturizing interact in determining the final state of the fiber structure, and so all stages of false twist texturizing may influence dyeing behavior and in particular dye uniformity.

False twist texturizing processes create an asymmetric distribution of forces in the filaments of a yarn, generally by subjecting various parts of a filament cross section to different levels of tension and/or compression. After the differential strains have been exerted the resulting distorted configuration is normally locked in through a thermal annealing treatment. This stabilized configuration is now the preferred and lowest internal energy state for the filaments. When these stabilized distortions are removed during untwisting or textile processing (i.e., winding, knitting, etc.) the internal strain energy of the filaments increases and a potential for crimping is established. Removal of processing constraints and exposure to warm, wet finishing treatments activate the crimp potential with a resulting elastic instability that results in filament crimp.

More specifically, on twisting, stresses develop within the yarns. There may be some slippage of the fiber elements past one another but a major realignment is prevented by the internal frictions. Consequently the fiber structure contains internal stresses while in the deformed state.

The application of heat to the twisted fiber increases the polymer chain mobility and permits stress relaxation to occur through realignment of the fiber elements, thereby stabilizing the deformed state through localized 'bond' breaking, 'bond' formation and recrystallization. Thus, the twisted or coiled state becomes the preferred, or most stable state of the fibers. The fibers are then untwisted, and straightened out by the processing tensions, so that although there is little obvious crimp or bulk at this stage, the fibers are all in a state of internal stress (i.e., latent crimp). The spontaneous development of crimp and bulk is inhibited by internal frictions in the cold fibers, because the polymer chain mobility is not sufficient to permit relaxation.

The latent crimp of texturized fibers may then be recovered by heating them for periods of time well known in the art above the glass transition temperature of the polymer. The polymer chains will thereby become mobile and the release of latent internal stresses will cause the fibers to bend and twist in proportion to the extent to which the tension on the fiber is reduced. If the heating process is carried out in a completely relaxed state, the maximum degree of twisting, crimping and coiling develops in each fiber.

The texturizing and crimping procedure may be performed either on-line or in a discontinuous manner.

In the on-line procedure, the fiber is passed through a first heating zone wherein it is heated for a period of about 0.002 to about 0.04 second, preferably from about 0.004 to about 0.009 second, to a temperature of about 180° to about 240° C., preferably from about 210° to about 230° C. The first heating zone should be substantially free of moisture and the heat applied to the fiber should be dry.

Any heating device known to those skilled in the art may be employed which preferably maximizes to the extent possible the uniformity of the temperature profile along its length.

As the fiber exits the first heating zone it is immediately passed through a pair of spindles which twist or rotate the fiber at a speed exceeding 200,000 rpm.

The fiber is then untwisted. At this point although the net twist is zero the fiber possesses a latent crimp (hence the term false-twist) which is developed or recovered by a subsequent heating step often referred to as heat setting.

Thus, in the on-line process, the latently crimped fiber is passed through a second heating zone at a controlled tension or overfeed using a pair of stress isolation devices similar to that described above to provide the desired degree relaxation depending on the end use of the fiber. The fiber is therein typically heated in the absence of moisture to a temperature of about 160° to about 230° C., preferably from about 180° to about 200° C., for a period of about 0.002 to about 0.04 second, preferably from about 0.004 to about 0.009 second to develop the crimp. Any heating device suitable for the purpose described above may be employed.

A representative example of a typical spindle false twist texturizing machine is the SCRAGGTM "mini-bulk" false twist texturizer equipped with a single 25 inch long heater, a yarn speed of about 230 ft./min., a false twist spindle speed of about 200,000 rpm, ±1% overfeed, and a theoretical (maximum) twist level of about 70 turns per inch (tpi). A friction disk false twist texturizer may also be employed.

In the discontinuous process, crimp development is postponed and the latently crimped fiber may be subjected to other processing steps before the latent crimp is actually developed. In such cases, crimp development may be combined with aqueous or thermal dyeing procedures where the temperatures employed are above about 95° C. Thus, the heat of the dye bath may be sufficient to achieve adequate crimp development. It is appropriate to mention that crimp developing procedures which employ moist heat may be conducted at lower temperatures than those which employ dry heat since moisture is a more efficient conductor of heat.

It should also be noted that in the discontinuous procedure as in the on-line procedure, the crimp development is proportional to the degree of relaxation to which the fiber is subjected during the crimp development stage.

Thus, the structural changes induced by false twist texturizing treatments are a function of time, temperature, tension and moisture content employed during processing and anyone skilled in the art can manipulate these variables in a well known manner and in accordance with the end use to which the fiber will be put.

The dyeing process which may be employed to dye the fibrous material described herein may be any process known to those skilled in the art which is suitable for dyeing polyethylene terephthalate fibers including aqueous dyeing, (e.g., employs an aqueous dye bath) and thermal dyeing (e.g., relies on sublimation of the dye at elevated temperatures) procedures. Such dyeing procedures may also include the use of common dye carriers.

The dyes which may be employed to dye the fibrous material may be any dye typically employed by one skilled in the art to dye polyethylene terephthalate fibers. Such dyes include disperse dyes such as those disclosed in U.S. Pat. No. 3,973,907 which is herein incorporated by reference.

The improvements in the uniformity of dye uptake can be illustrated by simulating the thermomechanical changes which the fibrous material would undergo in a typical false twist texturizing process. Thus, the figure contains two curves. Curve A is generated by providing several samples of a 170 denier, 36 filament yarn comprising substantially all polyethylene terephthalate and having a birefringence of about 0.190 and a denier per filament of about 5. Each sample is then exposed to a different temperature at constant length, as illustrated to induce changes in the fiber polymer structure and orientation which affect the uniformity of dye uptake, subsequently dyed, and the dye uptake determined. Thus, curve A represents a plot of dye uptake vs. temperature and operates as a control.

Curve B is generated in the same manner as curve A except that the fiber samples are contacted with superheated steam (150 psig) maintained at a temperature of about 150° C. for a period of 0.04 second, while permitting a shrinkage of 5% based on the original length of the fiber prior to exposing the yarn to the respective temperatures in the manner described.

The two curves A and B and the data embodied therein are used in coordination with the following discussion to illustrate the mechanism by which the controlled anneal treatment of the present invention is believed to operate to improve the uniformity of dye uptake of the fibrous material described herein although such description is not intended to be exhaustive of all mechanistic details.

Note that the procedures followed to obtain the thermally treated fibers of the figure are not the same as those employed in a commercial false twist texturizing treatment since the controlled application of deformation, moisture, and particularly tension typically employed in such procedures are absent. These variables, although capable of influencing the uniformity of dye uptake to some degree, do not pose serious problems to those skilled in the art since they can be adequately controlled to the extent that they are not a significant contributing factor to the overall problem of dye uniformity. It is the variations in thermal history of a fibrous material which are difficult to control and it is these variations which significantly affect dye uniformity. Consequently, although the structural changes (discussed below) which are induced in the fibers of the figure by the heating step are not exactly the same as would be induced by a typical false twist texturizing treatment, they are sufficiently similar thereto to cause a variation in the dye uptake similar to that which occurs in such a treatment as a result of variations in temperature and to illustrate the improvement in dye uniformity which occurs when the fibrous material is subjected to the controlled anneal step of the presently claimed invention.

Polymers typically employed in the preparation of melt spun yarn are crystallizable and can therefore have both an amorphous structure and a crystalline structure. The balance existing between these two structures (e.g., in terms of volume percentages) is progressively altered by thermal processing depending on the temperature employed.

Referring to the figure, it can be seen from the curve A that the dye uptake of polyethylene terephthalate yarn decreases as the temperature progresses from about 160° C. to about 210° C. It is believed that the variation in dye uptake corresponds to and is induced by variations in the amorphous-crystalline balance and orientation of the polymer comprising the yarn. At the inflection point which occurs at about 210° C., the overall structural balance is such that very little change occurs in the dye uptake for a corresponding change in temperature. At temperatures higher than about 210° C., the variation in dye uptake induced by slight temperature changes is again quite pronounced.

It has been found that it is possible to alter the amorphous-crystalline balance in relative volume as well as in overall orientation of a fibrous material prior to false twist texturizing processing in such a manner that the structure developed approaches or resembles the polymer structure which is less responsive, in terms of dye uptake, to variations in temperature. Such a structure is similar to that present at temperatures around the inflection point of curve A of the figure (e.g., about 180° to 220° C.).

The result of the controlled anneal treatment of the present invention is to flatten the dye uptake-temperature response curve at the temperature range of about 180° to 220° C. as depicted by curve B of the figure. Consequently, when the controlled anneal fibrous material is subsequently false twist texturized and then dyed, the uniformity of dye uptake is improved and the variations in dye shade of the resulting product is reduced.

The particular amorphous-crystalline balance and orientation developed by the above-described process, however, must still be capable of undergoing further alteration which will be induced by subsequent false twist texturizing techniques.

If the polymer structure is altered beyond the critical overall structural balance described above by annealing at temperatures in excess of 170° C. or at a controlled shrinkage or extension outside the limits described, the polymer will not respond to subsequent false twist processing in the manner described.

The short annealing times are critical in the sense that they are necessary for an economic and efficient operation of the annealing process.

Thus, the processing variables of fiber length during annealing, exposure time, and temperature are critical to achieve the efficient improvement in dye uniformity obtainable by the present invention.

The present invention is further illustrated by the following examples. All parts and percentages in the examples as well as in the specification and claims are by weight unless otherwise specified.

EXAMPLE 1

Polyethylene terephthalate having an inherent viscosity (I.V.) of 0.67 is selected as the starting material. The inherent viscosity is determined from a solution of 0.1 gram of the polymer in 100 gms. of orthochlorophenol at 25° C.

The polyethylene terephthalate is melt extruded through a spinneret having 30 extrusion holes each having a diameter of 20 mils. The molten polyethylene terephthalate is at a temperature of 300° C. when extruded through the spinneret. The resulting extruded polyethylene terephthalate is passed directly through a solidification zone having a length of 6 feet and a vertical disposition for a residence time of 0.045 seconds. While passing through the solidification zone the extruded polyethylene terephthalate is uniformly quenched with air at room temperature (e.g., about 25° C.) which is continuously introduced and withdrawn from said solidification zone at a rate of 400 meters per minute while under a low stress of 0.05 grams per denier and drawn down at a ratio of 1:1 and at a temperature of about 22° C. to impart an as-spun birefringence of about 0.005. The as-spun fibers are then hot drawn at a temperature of 90° C. at a draw ratio of 4.5:1 to yield a fiber having a birefringence of about 0.190 and a tenacity of 4 grams per denier.

The polyethylene terephthalate 160 denier/30 filament yarn is passed at controlled length through a steam chamber having an outer jacket or pipe and an inner tube with a plurality of openings along the length of the latter. The length of the fibrous material is controlled by passing the yarn over and about a first pair of skewed rolls located at the entrance to the steam chamber, through the steam chamber and over and about a second pair of skewed rolls located at the exit of the steam chamber at a speed ratio of 0.95. Steam is passed into the space between the outer pipe and the inner tube and through the openings of the inner tube thereby impinging on the yarn which continuously enters and exits the inner tube. The steam in the steam chamber is provided at a pressure sufficient to maintain the temperature of the steam as it impinges on or contacts the yarn at 150° C. The residence time during which the yarn is in contact with the superheated steam is 0.04 second.

The resulting controlled anneal yarn is then subjected to a thermomechanical treatment as follows:

The annealed yarn is passed about a pair of skewed rolls and over a curved hot shoe maintained at a temperature of 180° C. and about a second pair of skewed rolls at the exit of the hot shoe. The speed ratio of the two rolls is 1.0 and the contact time over the hot shoe is 0.25 second.

The thermomechanically treated yarn is then dyed with Eastman Blue BGLF dye using an aqueous dyeing procedure at atmospheric pressure. This dye is known to be a high energy dye and is extremely sensitive. Consequently, it is extremely efficient in emphasizing even very small variations in dye uptake which might not otherwise occur with less sensitive dyes.

More specifically, the fibrous material is knitted into a hoseleg configuration having a 3 inch diameter. A 3 inch strip is cut therefrom and immersed in an aqueous dye bath containing the dye and 1.45 gm/l of dye bath, of a dye carrier comprising a mixture of 0.50 gm. of IGEPON®-T-77 (a sulfo-amide anionic surfactant having the general formula $RCON(R')CH_2CH_2SO_3Na$), 0.50 gm. of CALGON® (a sodium phosphate glass commonly called sodium hexametaphosphate having a 1:1 molecular ratio of $Na_2O:P_2O_5$ with a guaranteed minimum of 67% $P_2O_5$), 0.25 gm. of acetic acid and 0.20 gm. of CAROLID®-ELF emulsifier (manufactured by Tantex Chemical Corporation). The dye is present in the dye bath at 4% (owf), and the liquid to solids weight ratio of the dye bath is 40:1. The temperature of the dye bath is raised to 95° C. for 1 hour.

The dyed sample is removed from the dye bath and placed in a scouring bath of 0.2% by solution weight, of a solution of a 1:1 weight ratio mixture of IGEPON®-T-77/trisodium phosphate dissolved in water which is maintained at a temperature of 60° C. for 20 minutes. This procedure is repeated several times with fresh scouring solution until the scouring bath remains clear after 20 minutes.

A 20 mg. portion of the scoured fabric is then dissolved in 1 ml of trifluroacetic acid which is subsequently diluted to a total volume of 25 ml with a 91:9 weight ratio mixture of methylene chloride/methanol respectively. The resulting solution if cloudy is passed through a MILLIPORE® filter. A sample of the scoured fabric is removed for determination of dye uptake from the % absorbance using a spectrophotometer at 600 μm wavelength.

The results are summarized in Table I as run 1.

The above procedure is repeated several times on different groups of samples with the exception that the temperature of the thermomechanical treatment for each sample within each group is varied as shown at Table I to simulate a broad range of possible thermal variations which might occur during false twist texturizing.

Each group of samples is also subjected to variations in the control exercised on the length of the fibrous material as illustrated by Table I in terms of speed ratio.

The dye uptake is then determined for all samples in each group in the manner described. The difference between highest and lowest dye uptake in each group is then determined and represents the maximum range of dye uptake variation. The results are summarized as runs 1 to 3 with each run representing a group of samples.

A control group of samples which have not undergone the controlled anneal process is also subjected to the thermomechanical treatment, tested for dye uptake and the range of dye uptake determined. These results are summarized at Table 1 as run 4.

EXAMPLE 2

Example 1 is repeated with the exception that (1) the temperature applied to the yarn during the controlled anneal treatment as illustrated at Table 1 is varied and a hot shoe is employed, instead of a steam jet, to achieve heating of the fibrous material during the controlled anneal treatment, (2) the dye used in the dyeing procedure is Latyl Blue BGLF, a DuPont blue disperse dyestuff, and (3) the speed ratio during the controlled anneal treatment is always 0.95.

The results are summarized as Example 2, runs 5 through 8 (including the control).

As may be seen from the results of Examples 1 and 2, the presently claimed process significantly improves the uniformity of dye uptake over the control as reflected by the maximum range of dye uptake variation data.

It is appropriate to mention that Examples 1 and 2 do not subject the fibrous material to a typical false twist texturizing procedure for reasons of convenience. As pointed out earlier in the specification, the structural changes which occur in a typical false twisting procedure are primarily a result of the tension and temperature to which the fibrous material is subjected. Consequently, a variation in either the tension or thermal history of the fibrous material during false twist texturizing will affect the uniformity of dye uptake. With the techniques available today, however, it is possible to accurately control the tension of the fibrous material during false twist texturizing to the extent that any variations which might occur therein are minimal and therefore do not significantly affect the uniformity of dye uptake. Therefore the examples have employed a constant tension in the sense that shrinkage is prevented at a speed ratio of 1.0. Consequently, variations in tension are substantially eliminated during the thermomechanical treatment of the examples. The focus of the examples is therefore on the effect which variations in temperature at uniform tension has on the uniformity of dye uptake. Thus, although the examples employ what is characterized as a thermomechanical treatment, in the sense that the fibrous material is subjected to heat and substantially uniform tension, such thermomechanical treatment is sufficient to simulate, to the extreme, the variations in temperature which can occur during a false twist texturizing treatment. The thermomechanical treatment of the examples therefore permits one to isolate and study the effects of variations in the thermal history of the fibrous material on uniformity of dye uptake and to evaluate the ability of the presently claimed invention to counteract the variations in dye uniformity which result from such variations in thermal history.

Since the variations in thermal history under examination are substantially the same for either the thermomechanical treatment of the examples or false twist texturizing, the data obtained from the examples in terms of the proportionate improvement in dye uniformity is equally applicable to false twist texturizing.

TABLE I

| Example No. | Run No. | Controlled Anneal Process: Speed Ratio | Temp. °C. Hotshoe | Temp. °C. Steam | Time (second) | Thermochemical Treatment: Speed Ratio | Temp. °C. | Time (second) | Dye Uptake (mg/gm) | Maximum Range of Dye Uptake Variation (mg/gm) |
|---|---|---|---|---|---|---|---|---|---|---|
| 1 | | | | | | | | | | |
| | 1 a | .95 | | 150° | .04 | 1.0 | 180° | .25 | 6.74 | |
| | b | .95 | | 150° | .04 | 1.0 | 190° | .25 | 6.61 | |
| | c | .95 | | 150° | .04 | 1.0 | 200° | .25 | 6.30 | |
| | d | .95 | | 150° | .04 | 1.0 | 210° | .25 | 5.63 | 1.36 |
| | e | .95 | | 150° | .04 | 1.0 | 220° | .25 | 5.38 | |
| | f | .95 | | 150° | .04 | 1.0 | 230° | .25 | 5.49 | |
| | 2 a | 1.0 | | 150° | .04 | 1.0 | 180° | .25 | 5.88 | |

TABLE I-continued

| Example No. | Run No. | Controlled Anneal Process Speed Ratio | Temp. °C. Hotshoe | Temp. °C. Steam | Time (second) | Thermochemical Treatment Speed Ratio | Temp. °C. | Time (second) | Dye Uptake (mg/gm) | Maximum Range of Dye Uptake Variation (mg/gm) |
|---|---|---|---|---|---|---|---|---|---|---|
| | b | 1.0 | | 150° | .04 | 1.0 | 190° | .25 | 5.74 | |
| | c | 1.0 | | 150° | .04 | 1.0 | 200° | .25 | 5.40 | |
| | d | 1.0 | | 150° | .04 | 1.0 | 210° | .25 | 4.78 | 1.59 |
| | e | 1.0 | | 150° | .04 | 1.0 | 220° | .25 | 4.29 | |
| | f | 1.0 | | 150° | .04 | 1.0 | 230° | .25 | 4.76 | |
| | 3 a | 1.05 | | 150° | .04 | 1.0 | 180° | .25 | 4.98 | |
| | b | 1.05 | | 150° | .04 | 1.0 | 190° | .25 | 4.84 | |
| | c | 1.05 | | 150° | .04 | 1.0 | 200° | .25 | 4.49 | |
| | d | 1.05 | | 150° | .04 | 1.0 | 210° | .25 | 3.92 | 1.79 |
| | e | 1.05 | | 150° | .04 | 1.0 | 220° | .25 | 3.19 | |
| | f | 1.05 | | 150° | .04 | 1.0 | 230° | .25 | 4.02 | |
| Control | 4 a | N/A | | N/A | N/A | 1.0 | 180° | .25 | 6.14 | |
| | b | N/A | | N/A | N/A | 1.0 | 190° | .25 | 5.18 | |
| | c | N/A | | N/A | N/A | 1.0 | 200° | .25 | 4.79 | |
| | d | N/A | | N/A | N/A | 1.0 | 210° | .25 | 4.22 | 1.92 |
| | e | N/A | | N/A | N/A | 1.0 | 220° | .25 | 4.48 | |
| | f | N/A | | N/A | N/A | 1.0 | 230° | .25 | 5.17 | |
| 2 | | | | | | | | | | |
| | 5 a | .95 | 160° | | .04 | 1.0 | 180° | .25 | 3.50 | |
| | b | .95 | 160° | | .04 | 1.0 | 190° | .25 | 3.16 | |
| | c | .95 | 160° | | .04 | 1.0 | 200° | .25 | 2.89 | 0.70 |
| | d | .95 | 160° | | .04 | 1.0 | 210° | .25 | 2.83 | |
| | e | .95 | 160° | | .04 | 1.0 | 220° | .25 | 2.80 | |
| | 6 a | .95 | 140° | | .04 | 1.0 | 180° | .25 | 3.51 | |
| | b | .95 | 140° | | .04 | 1.0 | 190° | .25 | 3.00 | |
| | c | .95 | 140° | | .04 | 1.0 | 200° | .25 | 2.66 | 0.85 |
| | d | .95 | 140° | | .04 | 1.0 | 210° | .25 | 2.76 | |
| | e | .95 | 140° | | .04 | 1.0 | 220° | .25 | 3.00 | |
| | 7 a | .95 | 120° | | .04 | 1.0 | 180° | .25 | 3.72 | |
| | b | .95 | 120° | | .04 | 1.0 | 190° | .25 | 3.19 | |
| | c | .95 | 120° | | .04 | 1.0 | 200° | .25 | 3.10 | 1.07 |
| | d | .95 | 120° | | .04 | 1.0 | 210° | .25 | 2.80 | |
| | e | .95 | 120° | | .04 | 1.0 | 220° | .25 | 2.65 | |
| Control | 8 a | N/A | N/A | | N/A | 1.0 | 180° | .25 | 3.61 | |
| | b | N/A | N/A | | N/A | 1.0 | 190° | .25 | 3.00 | |
| | c | N/A | N/A | | N/A | 1.0 | 200° | .25 | 2.61 | 1.22 |
| | d | N/A | N/A | | N/A | 1.0 | 210° | .25 | 2.39 | |
| | e | N/A | N/A | | N/A | 1.0 | 220° | .25 | 2.40 | |

Although the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. In a process for providing a dyed, false twist texturized fibrous material comprising at least 85 mole percent polyethylene terephthalate which is subject to variations in dye uptake induced by a false twist texturizing treatment conducted on said fibrous material prior to or concurrently with a dyeing process, the improvement which comprises enhancing the uniformity of dye uptake of said fibrous material by:

(a) providing a fibrous material comprising at least 85 mole percent polyethylene terephthalate having a birefringence of at least 0.1 prior to said false twist texturizing treatment; and, (b) annealing said fibrous material of (a) at a temperature of about 120° to about 160° C. while controlling the length thereof in a manner sufficient to prevent a longitudinal shrinkage greater than about 10% and a longitudinal extension greater than about 5% based on the original length of the fibrous material prior to annealing, for a period of about 0.01 to about 1 second.

2. The process of claim 1 wherein the fibrous material is annealed for a period of about 0.02 to about 0.6 second.

3. The process of claim 1 wherein the fibrous material is in the configuration of a yarn, tow or monofilament.

4. The process of claim 1 wherein the fibrous material is annealed by contact with superheated steam.

5. The process of claim 1 wherein the length of the fibrous material is controlled in a manner sufficient to obtain a longitudinal shrinkage of about 5 to about 0% based on the original length of the fibrous material prior to annealing.

6. The process of claim 1 wherein the fibrous material is substantially all polyethylene terephthalate.

7. The process of claim 1 wherein the fibrous material is annealed for a period of about 0.04 to about 0.4 second.

8. The process of claim 1 wherein the fibrous material is annealed at a temperature of about 145° to about 150° C.

9. The process of claim 1 wherein the birefringence of said fibrous material of (a) is from about 0.14 to about 0.21.

10. The process of claim 1 wherein the birefringence of said fibrous material of (a) is from about 0.18 to about 0.20.

11. In a continuous process for providing a dyed, false twist texturized fibrous material comprising at least 85 mole percent polyethylene terephthalate which is subject to variations in dye uptake induced by a false twist texturizing treatment conducted on said fibrous material prior to or concurrently with a dyeing process, the improvement which comprises enhancing the uniformity of dye uptake of said fibrous material by:

(a) passing a continuous length of a fibrous material comprising at least 85 mole percent polyethylene terephthalate having a birefringence of about 0.14 to about 0.21 in the direction of its length through an annealing zone while controlling the length thereof in a manner sufficient to prevent a longitudinal shrinkage greater than about 5% and a longitudinal extension greater than about 5% based on the original length of the fibrous material prior to annealing, for a residence time within said annealing zone of about 0.01 to about 1 second prior to said false twist texturizing treatment; and (b) contacting said fibrous material of (a) as it passes through said annealing zone with superheated steam maintained at a temperature of about 120° to about 160° C.

12. The process of claim 11 wherein the residence time of the fibrous material within the annealing zone is about 0.02 to about 0.6 second.

13. The process of claim 11 wherein the residence time of the fibrous material within the annealing zone is about 0.04 to about 0.4 second.

14. The process of claim 11 wherein the length of the fibrous material is controlled in a manner sufficient to obtain a longitudinal shrinkage of about 5 to about 0%, based on the original length of the fibrous material prior to annealing.

15. The process of claim 11 wherein the fibrous material is substantially all polyethylene terephthalate.

16. The process of claim 11 wherein the superheated steam is maintained at a temperature of about 145° to about 150° C.

17. The process of claim 11 wherein the birefringence of said fibrous material of (a) is about 0.14 to about 0.21.

18. The process of claim 11 wherein the birefringence of said fibrous material of (a) is about 0.18 to about 0.20.

* * * * *